US011000868B2

(12) United States Patent
Burgess

(10) Patent No.: US 11,000,868 B2
(45) Date of Patent: May 11, 2021

(54) HIGH VELOCITY SPRAY TORCH FOR SPRAYING INTERNAL SURFACES

(71) Applicant: Alan W. Burgess, North Vancouver (CA)

(72) Inventor: Alan W. Burgess, North Vancouver (CA)

( * ) Notice: Subject to any disclaimer, the term of this patent is extended or adjusted under 35 U.S.C. 154(b) by 4 days.

(21) Appl. No.: 16/329,103

(22) PCT Filed: Sep. 6, 2017

(86) PCT No.: PCT/CA2017/051044
§ 371 (c)(1),
(2) Date: Feb. 27, 2019

(87) PCT Pub. No.: WO2018/045457
PCT Pub. Date: Mar. 15, 2018

(65) Prior Publication Data

US 2019/0224701 A1 Jul. 25, 2019

Related U.S. Application Data

(60) Provisional application No. 62/384,272, filed on Sep. 7, 2016.

(51) Int. Cl.
*B05B 7/20* (2006.01)
*B05B 5/12* (2006.01)
(Continued)

(52) U.S. Cl.
CPC ..... *B05B 7/205* (2013.01); *B05B 1/00* (2013.01); *B05B 5/12* (2013.01); *B05D 7/22* (2013.01); *C23C 4/06* (2013.01); *C23C 4/129* (2016.01)

(58) Field of Classification Search
USPC ..... 118/302, 306, 317; 239/79, 424; 427/446, 449, 230, 236
See application file for complete search history.

(56) References Cited

U.S. PATENT DOCUMENTS 4,370,538 A 1/1983 Browning
4,416,421 A 11/1983 Browning
(Continued)

FOREIGN PATENT DOCUMENTS

CA 2445169 10/2002
CA 2481152 3/2005
(Continued)

OTHER PUBLICATIONS

"Method of manufacturing TiO2 nanoparticles by plasma thermal spraying metal organic liquid material", Feng, Lajun, et al., Journal of Yunnan University, 2005, 27 (S1). English abstract on p. 4.
(Continued)

*Primary Examiner* — Yewebdar T Tadesse
(74) *Attorney, Agent, or Firm* — Oyen Wiggs Green & Mutala LLP

(57) ABSTRACT

A thermal spray apparatus to apply coatings to external and internal surfaces in restricted areas is provided. The apparatus includes: a fuel input line; an oxidizing gas input line; coolant input and outlet; a combustion chamber that facilitates primary combustion; a diverging section that splits the primary combustion flow into two or more streams; an elbow section that redirects the combustion streams; a convergent/divergent nozzle; a convergence section that recombines the combustion streams into a single combustion stream within an injection zone of the convergent/divergent nozzle; and a feedstock injector for the injection of feedstock material for forming said coatings into said injection zone of the convergent/divergent nozzle; wherein the convergent/divergent nozzle has a nozzle throat downstream of the injection zone whereby in operation the injection pressure of the feedstock material upstream of the nozzle throat approximates the pressure of the combustion stream within
(Continued)

the injection zone. The apparatus may also include the use of an accelerating gas.

20 Claims, 19 Drawing Sheets

(51) Int. Cl.

| | |
|---|---|
| ***B05D 7/22*** | (2006.01) |
| ***B05B 1/00*** | (2006.01) |
| ***C23C 4/06*** | (2016.01) |
| ***C23C 4/129*** | (2016.01) |

(56) References Cited

U.S. PATENT DOCUMENTS

| | | | | |
|---|---|---|---|---|
| 4,836,447 | A | 6/1989 | Browning | |
| 5,073,193 | A | 12/1991 | Chaklader et al. | |
| 5,120,582 | A | 6/1992 | Browning | |
| 5,271,965 | A | 12/1993 | Browning | |
| 5,330,798 | A | 7/1994 | Browning | |
| 5,334,235 | A | 8/1994 | Dorfman et al. | |
| 5,770,126 | A | 6/1998 | Singh et al. | |
| 5,788,738 | A | 8/1998 | Pirzada et al. | |
| 5,851,507 | A | 12/1998 | Pirzada et al. | |
| 6,202,939 | B1 * | 3/2001 | Delcea | B05B 7/205 239/424 |
| 6,245,390 | B1 | 6/2001 | Baranovski et al. | |
| 6,392,189 | B1 * | 5/2002 | Delcea | H05H 1/42 219/121.47 |
| RE37,853 | E | 9/2002 | Detering et al. | |
| 6,472,632 | B1 | 10/2002 | Peterson et al. | |
| 6,569,397 | B1 | 5/2003 | Yadav et al. | |
| 6,580,051 | B2 | 6/2003 | Peterson et al. | |
| 6,689,192 | B1 | 2/2004 | Phillips et al. | |
| 6,886,757 | B2 | 5/2005 | Byrnes et al. | |
| 7,108,893 | B2 | 9/2006 | Van Steenkiste et al. | |
| 7,125,537 | B2 | 10/2006 | Liao et al. | |
| 7,608,797 | B2 | 10/2009 | Belashchenko et al. | |
| 8,455,056 | B1 | 6/2013 | Browning | |
| 2002/0155059 | A1 | 10/2002 | Boulos et al. | |
| 2003/0116228 | A1 | 6/2003 | Pozarnsky | |
| 2003/0143153 | A1 | 7/2003 | Boulos et al. | |
| 2004/0226508 | A1 | 11/2004 | Ma et al. | |
| 2005/0118094 | A1 | 6/2005 | Zhang | |
| 2005/0186132 | A1 | 8/2005 | Liao et al. | |
| 2005/0199739 | A1 | 9/2005 | Kuroda et al. | |
| 2005/0255419 | A1 | 11/2005 | Belashchenko et al. | |
| 2010/0136229 | A1 | 6/2010 | Kawakita et al. | |
| 2011/0229649 | A1 | 9/2011 | Baranovski et al. | |
| 2012/0082797 | A1 | 4/2012 | Allcock et al. | |
| 2013/0160606 | A1 | 6/2013 | Halder et al. | |
| 2014/0370324 | A1 | 12/2014 | Watanabe et al. | |

FOREIGN PATENT DOCUMENTS

| | | | |
|---|---|---|---|
| CN | 2629878 | Y | 8/2004 |
| DE | 4111231 | A1 | 10/1992 |
| EP | 0049915 | B1 | 6/1985 |
| EP | 1415741 | A2 | 5/2004 |
| EP | 1514845 | A1 | 3/2005 |
| WO | 02/061163 | A2 | 8/2002 |
| WO | 02/086179 | A2 | 10/2002 |
| WO | 03/097521 | A1 | 11/2003 |
| WO | 2004/007357 | A1 | 1/2004 |
| WO | 2004/052778 | A2 | 6/2004 |
| WO | 2004/056461 | A2 | 7/2004 |
| WO | 2007109906 | A1 | 10/2004 |
| WO | 2004/103900 | A1 | 12/2004 |
| WO | 2009/155702 | A1 | 12/2009 |

OTHER PUBLICATIONS

International Search Report completed on Jul. 9, 2007 in respect of Patent Cooperation Treaty Application No. PCT/CA2007/00514 (Publ. No. WO 2007/109906).

Supplementary European Search Report (EPO Form 1503) dated Mar. 27, 2020 issued on EP Appl. No. EP 17 84 7845.

* cited by examiner

HIGH VELOCITY SPRAY TORCH FOR SPRAYING INTERNAL SURFACES

CROSS REFERENCE TO RELATED APPLICATION

The present application claims the benefits, under 35 U.S.C. § 119(e), of U.S. Provisional Application Ser. No. 62/384,272 filed Sep. 7, 2016 entitled "High Velocity Spray Torch with Liquid or Gas Coolant and Accelerant" which is incorporated herein by this reference.

TECHNICAL FIELD

The present invention relates to thermal spray devices and processes for coating deposition, and more particularly to High Velocity Oxygen Fuel (HVOF) or High Velocity Air Fuel (HVAF) spray processes used to apply wear and corrosion resistant coatings for commercial applications.

BACKGROUND

Thermal spray apparatus and methods are used to apply coatings of metal or ceramics to different substrates. The HVOF process was first introduced as a further development of the flame spray process. It did this by increasing the combustion pressure to 3-5 Bar, and now most third generation HVOF torches operate in the 8-12 Bar range with some exceeding 20 Bar. In the HVOF process, the fuel and oxygen are combusted in a chamber. Combustion products are expanded in an exhaust nozzle reaching sonic and supersonic velocities.

In the first commercial HVOF system, Jet Kote™, developed by James Browning, particle velocities were increased from approximately 50 m/s for the flame spray process to about 450 m/s. The increased particle velocities resulted in improved coating properties in terms of density, cohesion and bond strength resulting in superior wear and corrosion properties. In the past thirty years many variations of this process have been introduced. Modern third generation HVOF guns with de Laval, convergent-divergent nozzles result in mean particle velocities on the order of 1000 m/s. High velocity air fuel (HVAF) spray processes have become more popular due to the potentially better economics using lower cost air as opposed to oxygen. HVAF torches operate at lower temperatures due to the energy required to heat the nitrogen in the air that does not participate in the combustion process in any significant way compared to HVOF torches at the same fuel flow rates.

Key high velocity torch and process design features are largely dictated by the type of fuel used. Fuels used can be gaseous such as propane, methane, propylene, MAPP-gas, natural gas and hydrogen, or liquid hydrocarbons such as kerosene and diesel. Other considerations include: a) combustion chamber design; b) torch cooling media; c) nozzle design; d) powder injection; and e) secondary air. The choice of the combustible fuel determines the following flame parameters: a) flame temperature; b) stoichiometric oxygen requirement; and c) reaction products. These combustion characteristics along with a fixed high velocity torch internal geometry determine particle acceleration and velocity and particle temperature.

With current systems the nozzle exit of the torch must be about 6 inches from the surface to be coated in order for the particles to reach sufficient velocity and temperature when they reach the target surface in order to provide a suitable coating. This makes the coating of surfaces in restricted areas, for example the inside surfaces of small pipes, difficult or impossible. There is therefore a need for a thermal spray torch in which the particle temperature and velocity is reached in a shorter distance from the nozzle to permit coating in smaller, restricted areas.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

The present invention relates to a method and apparatus to provide a high velocity flame torch suitable to apply coatings to external and internal surfaces in restricted areas. By configuring the nozzle dimensions and combustion gas passages whereby in operation the injection pressure of the feed stock material upstream of the nozzle throat approximates the combustion pressure upstream of the nozzle throat, a higher particle velocity and temperature within a shorter distance from the nozzle exit is permitted. This may be achieved by maintaining a low ratio of nozzle length to nozzle throat diameter, namely 5 or less, and using a narrow throat diameter to maintain high pressure in the injection zone so that the injection pressure of the feed stock material approximates the combustion pressure. It may also be achieved by providing a combustion gas passage for the flow of the combustion gas between the combustion chamber and the nozzle whose cross-sectional area is not significantly constricted between the combustion chamber and the nozzle exit except for the nozzle throat. This may also be achieved by configuring the combustion gas passage whereby the sum of the cross-sectional areas of the hot gas passages at each location downstream from the combustion chamber to the nozzle throat is greater than the cross-sectional area of the nozzle throat, whereby the injection pressure approximates the combustion pressure.

A thermal spray apparatus to apply coatings to external and internal surfaces in restricted areas is provided, the apparatus comprising:

a. a fuel input line;
b. an oxidizing gas input line;
c. coolant circulation;
d. a combustion chamber for primary combustion;
e. a diverging section that splits the primary combustion flow into two or more streams;
f. an elbow section that redirects the combustion streams;
g. a convergent/divergent nozzle;
h. a convergence section that recombines the combustion streams into a single combustion stream within an injection zone of said convergent/divergent nozzle; and
i. a feedstock injector for the injection of feedstock material for forming said coatings into said injection zone of said convergent/divergent nozzle;

wherein said convergent/divergent nozzle has a nozzle throat downstream of said injection zone whereby in operation the injection pressure of the feedstock material upstream of the nozzle throat approximates the pressure of said combustion stream within said injection zone.

The present invention combusts a fuel with an oxidizer to produce a high velocity jet and further accelerating this jet with an optional accelerating gas. There are generally at least two types of accelerating gas that can be used. These include a gas such as nitrogen, carbon dioxide or argon or alternatively a combustible fuel to increase temperature and pressure. Using a high density gas such as carbon dioxide or argon increases the drag coefficient and accelerates the feedstock material faster. Increasing the pressure of the gas will also increase the density of the gas though the ideal gas law.

$\rho=P/RT$, where $\rho$=density, P=pressure, R=Gas constant, T=temperature

A combination of carbon dioxide and a combustion gas can also be used. It is also possible to use supercritical carbon dioxide as a high density fluid to increase the drag coefficient.

Closer spray distance can also be obtained through a combination of the following characteristics:

a. Small physical size;
b. Use of small diameter nozzles;
c. Increased injection pressure;
d. Use of accelerating gas; and
e. Increased power relative to torch size.

The injection of the optional accelerating gas may be upstream of the nozzle. The accelerating gas can be added to the oxidizing gas input, as is the case with HVAF where nitrogen is a dilatant of oxygen in the form of air and in effect acts as an accelerating gas. Having an accelerating gas added to the oxidant gas stream, in an amount less than the 78%, which is the approximate volume fraction of nitrogen in air, can be used. For example nitrogen could be added at 20% that would increase the total gas flow over a stoichiometric gas mixture, but not decrease the overall temperature of the gas as would be the case with air at 78% nitrogen.

The high velocity torch may be water cooled or Air and/or $CO_2$ cooled. However, the use of Air and/or $CO_2$ may restrict the power level the torch can reach and therefore water cooling is preferred.

The convergence and nozzle design can result in higher injection pressures. The convergent divergent nozzle is characterized by the throat diameter. The smaller this throat diameter is the higher the pressure for a given gas flow. This increased pressure has the benefit of increasing heat transfer from the hot combustion gas to the feed stock material, usually a powder, and also increasing the pressure in the converging gas and feed stock region. Therefore, particles can reach the desired temperature and velocity without the use of an accelerating gas.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1A:
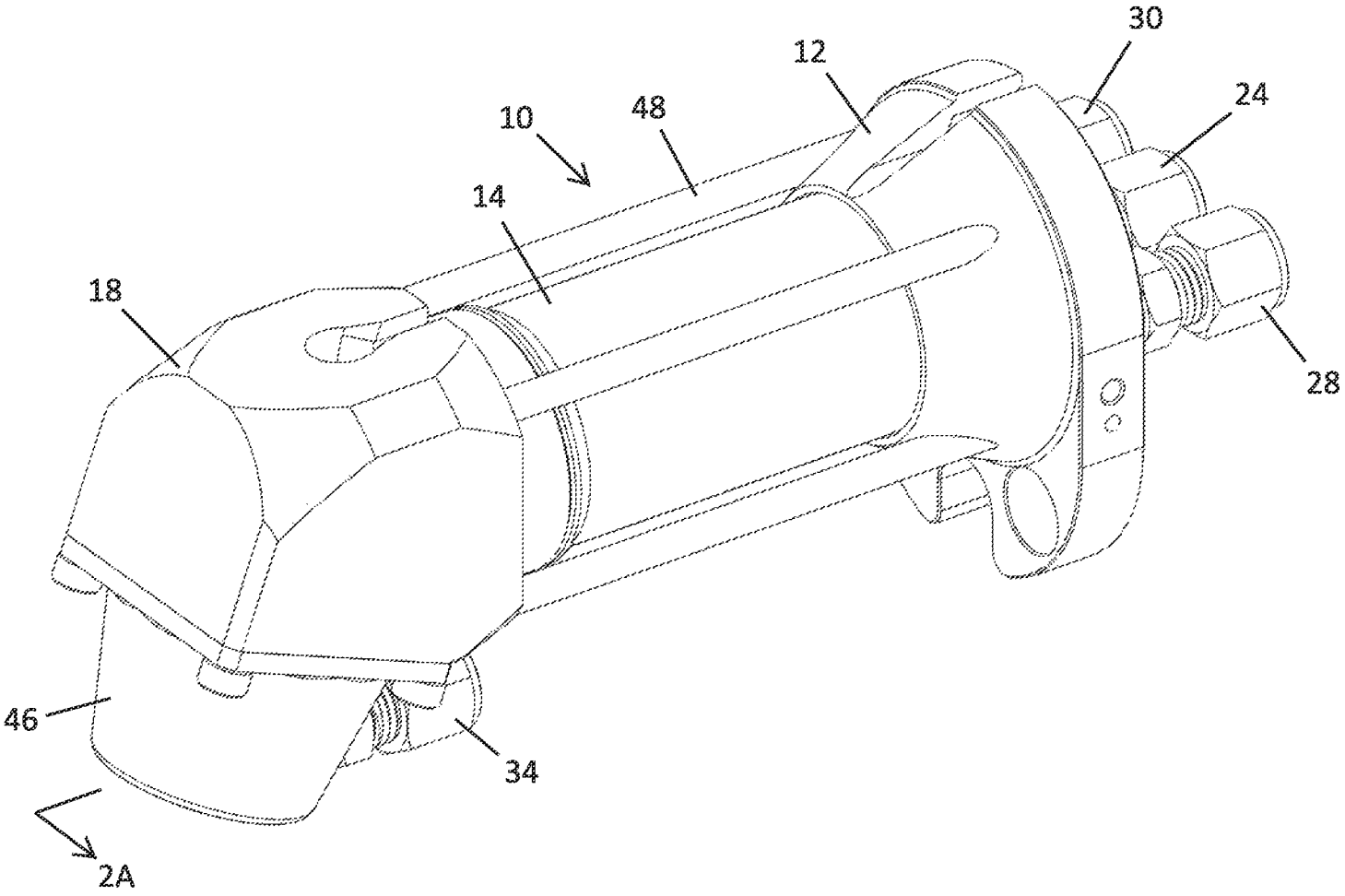
FIG. 1A is an isometric view of a water cooled thermal spray gun with exterior powder feed line and coolant water return line removed for illustrative purposes.
Figure 2A:
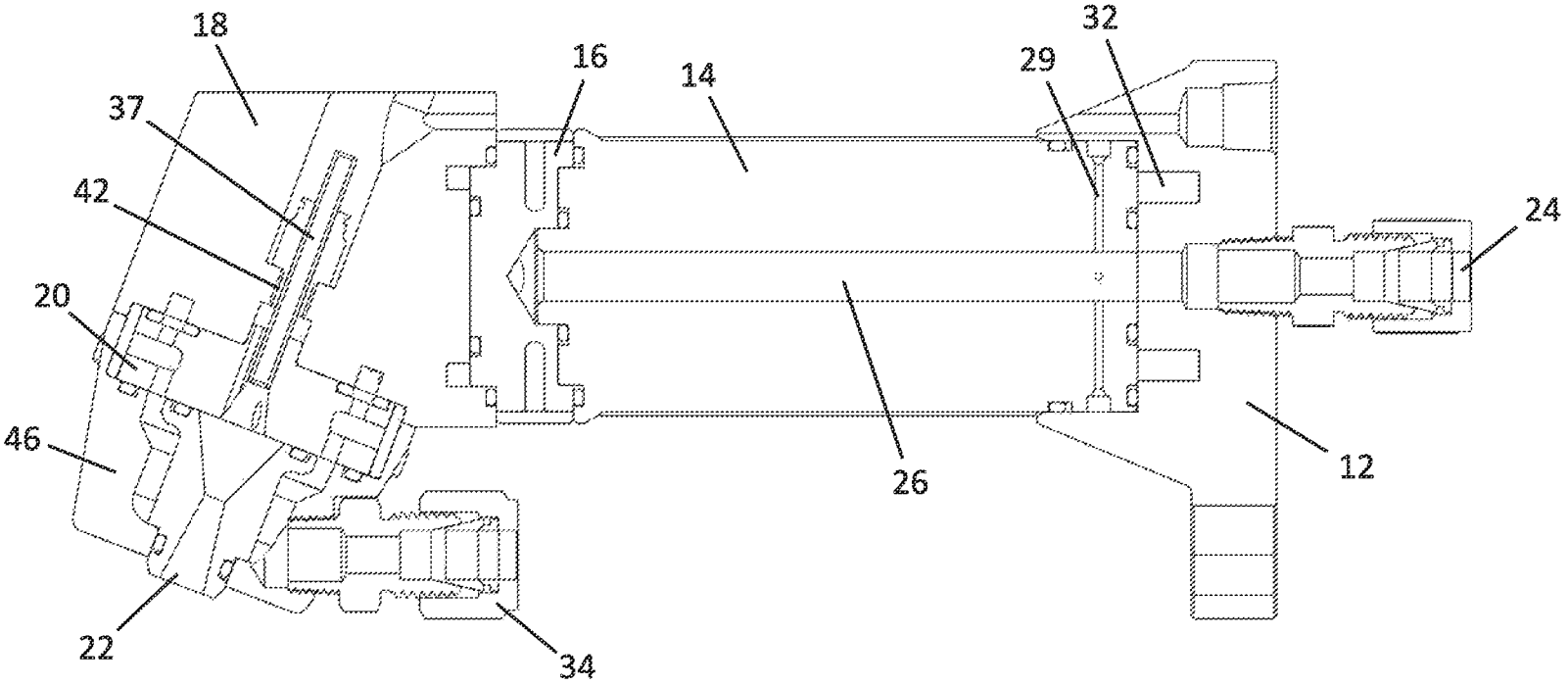
FIG. 2A is a longitudinal vertical cross-sectional view of the thermal spray gun shown in FIG. 1A taken along line 2A of FIG. 1A.
Figure 2B:
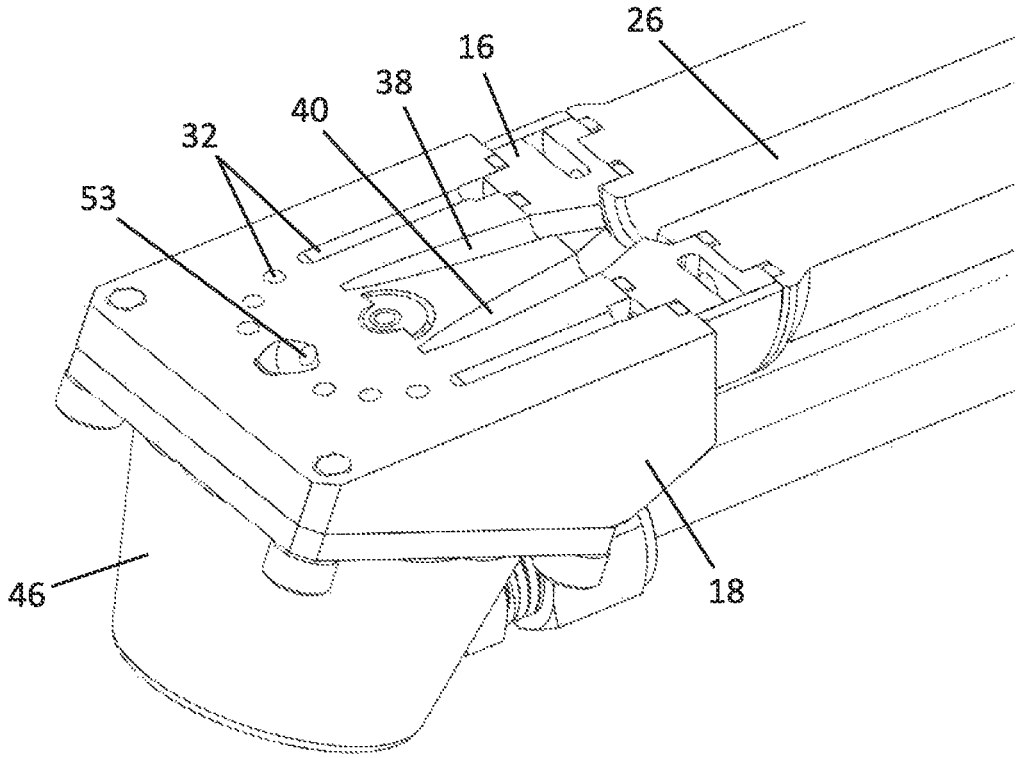
FIG. 2B is a detail horizontal cross-section along line 2B of FIG. 1B to show the multiple streams of combustion product, accelerating gas and powder feed upstream of the nozzle.
Figure 4A:
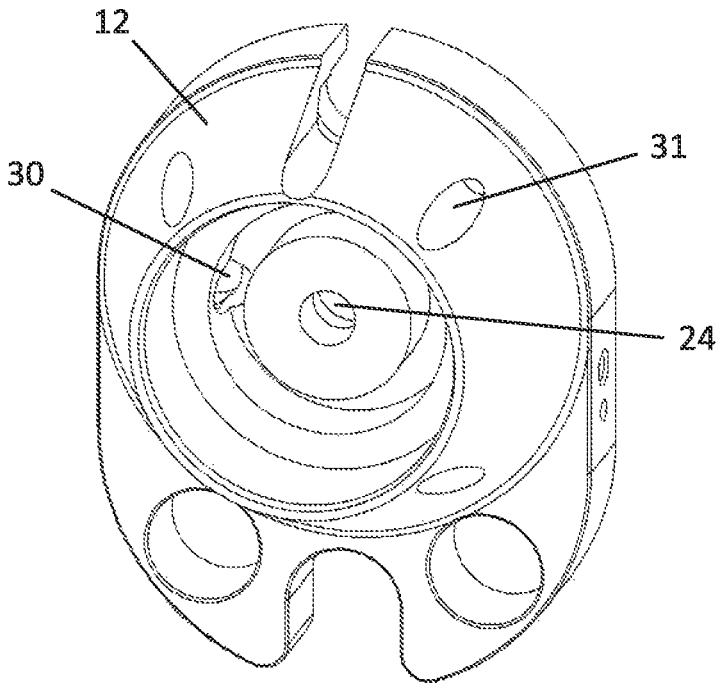
FIG. 4A is a top front isometric view of the base plate in isolation.
Figure 4B:
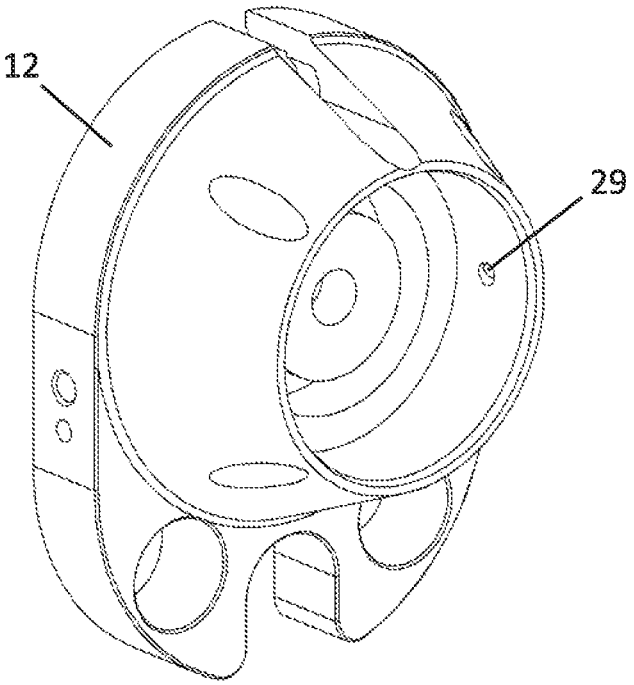
FIG. 4B is a left front isometric view of the base plate in isolation.
Figure 7A:
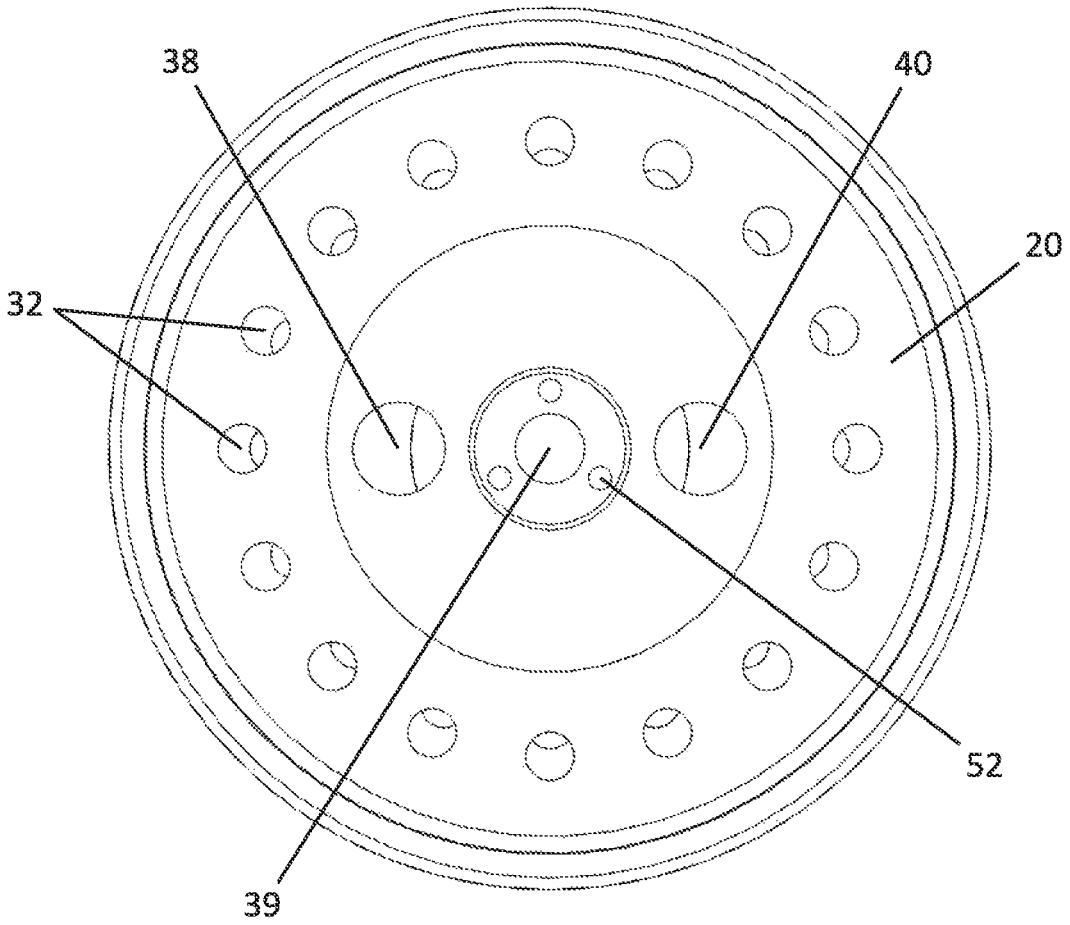
FIG. 7A is a rear view of the convergence section of the thermal spray gun accelerating gas embodiment in isolation.
Figure 7B:
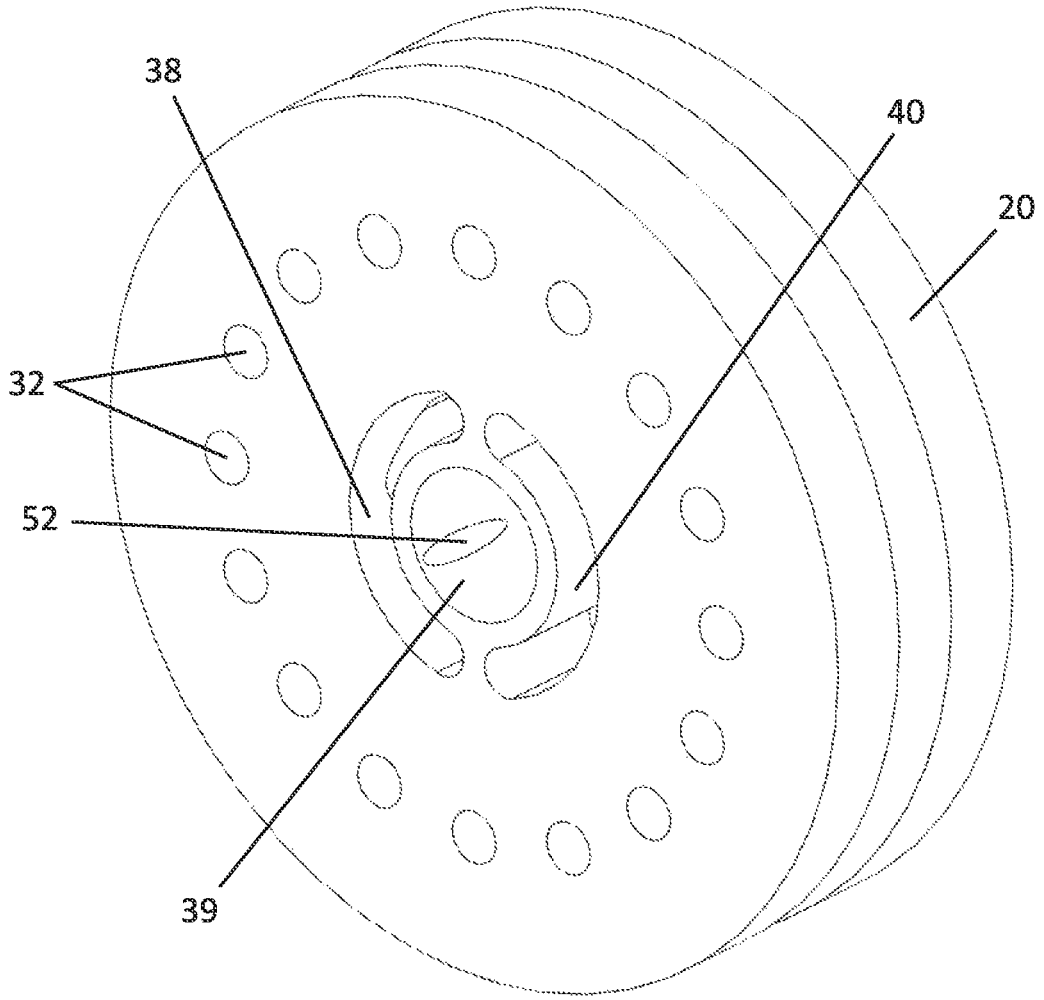
FIG. 7B is a front isometric view of the convergence section of the thermal spray gun with accelerating gas in isolation.
Figure 8:
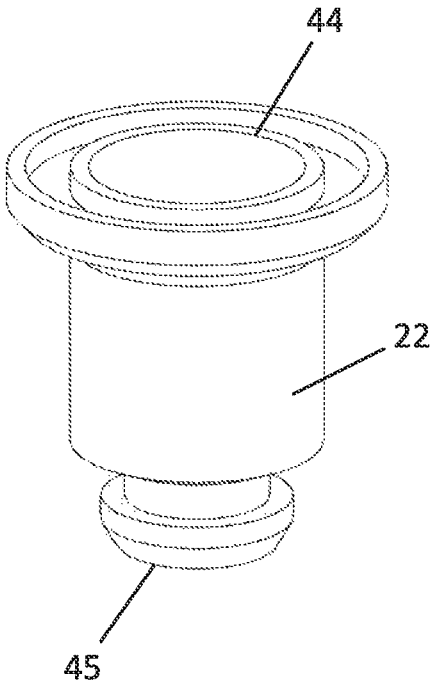
FIG. 8 is a front isometric view of the nozzle of the thermal spray gun in isolation.
Figure 9:
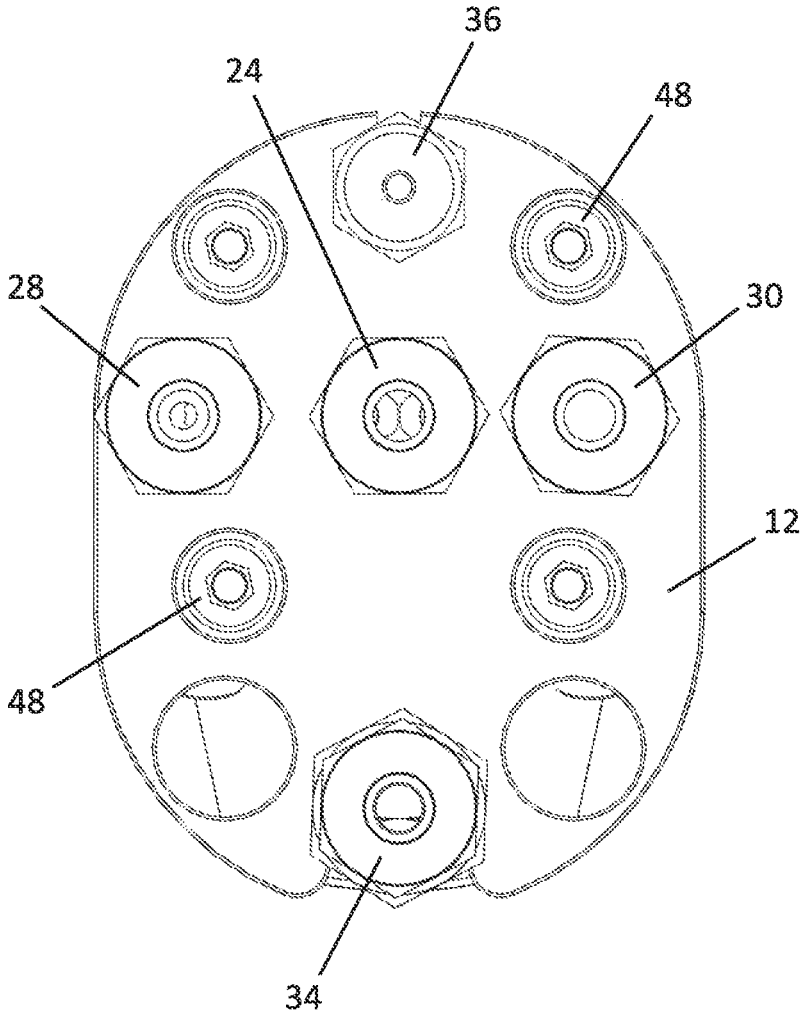
FIG. 9 is a rear view of the thermal spray gun.

With reference to FIG. 1A, in which the exterior powder feed line and coolant water line are removed for illustrative purposes the novel High Velocity thermal spray gun to spray wear and corrosion-resistant coatings 10 has a base plate 12 in which are located various input passages and chambers. It includes a combustion chamber 14, divergence section 16 and elbow housing 18, convergence assembly 20 (FIG. 7A, 7B) and nozzle 22 (FIG. 2A, FIG. 8). Nozzle 22 is retained in nozzle housing 46. Rigid tie rods 48 strengthen the torch body, by connecting base plate 12 at mounting holes 31 (FIG. 4A) to the elbow housing 18. Water cooling, entering or leaving through water line 30, 34 is preferred but air and/or $CO_2$ cooling may also be incorporated through the use of an accelerating fluid such as gas that goes through recuperative heating while cooling the torch. In the illustrated embodiment in FIG. 1A an accelerating gas enters the gas stream through passages 50, 52 into the convergence area around the powder feed injection port 39 as described below. Hydrogen is the preferred fuel, however other fuel gases such as methane, ethylene, ethane, propane, propylene or liquid fuels such as kerosene or diesel can be used. The feed stock may be powder, liquid or a suspension of powder in liquid.

Figure 1B:
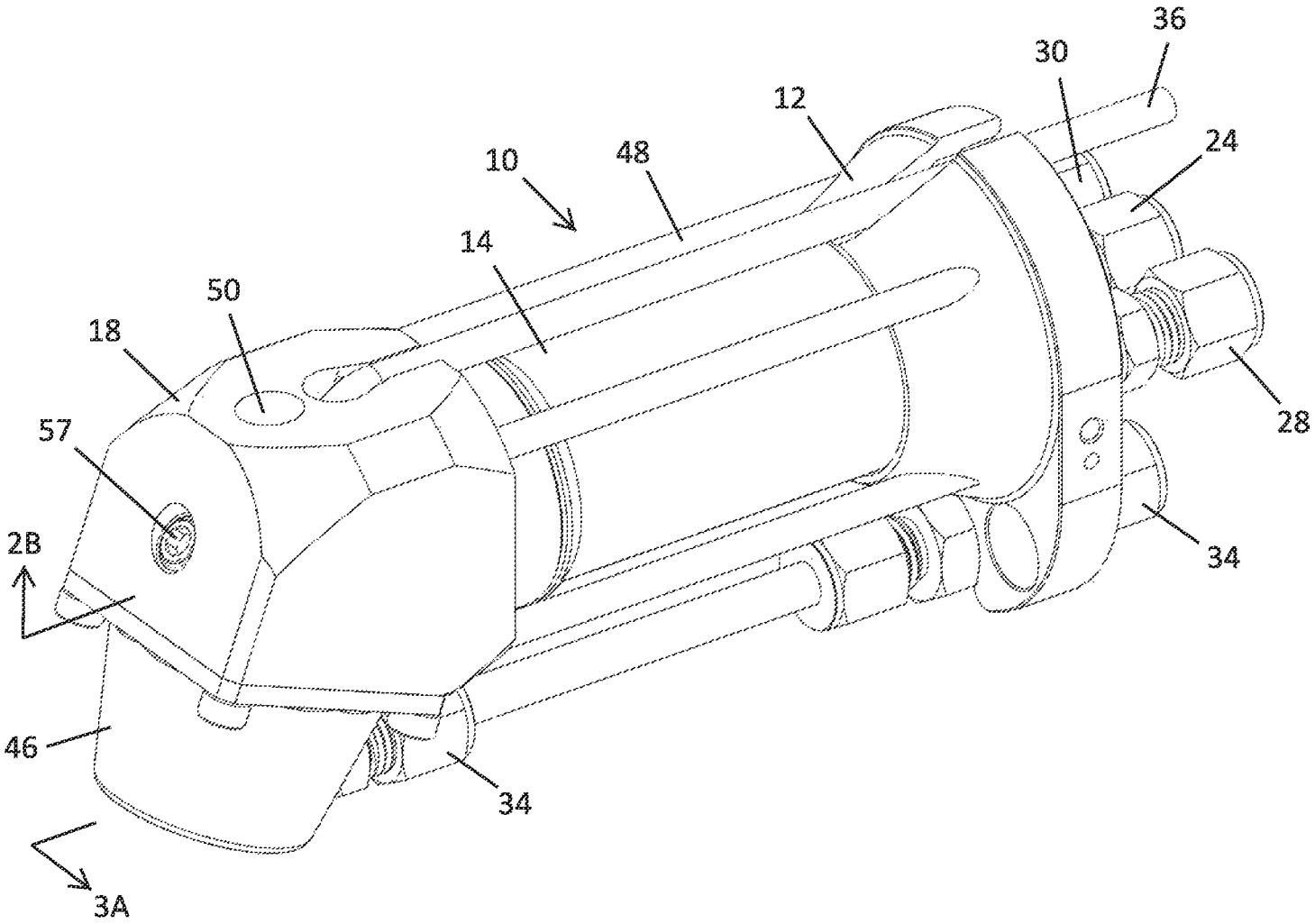
FIG. 1B is an isometric view of a water cooled thermal spray gun with a convergence accelerating gas port.
Figure 3A:
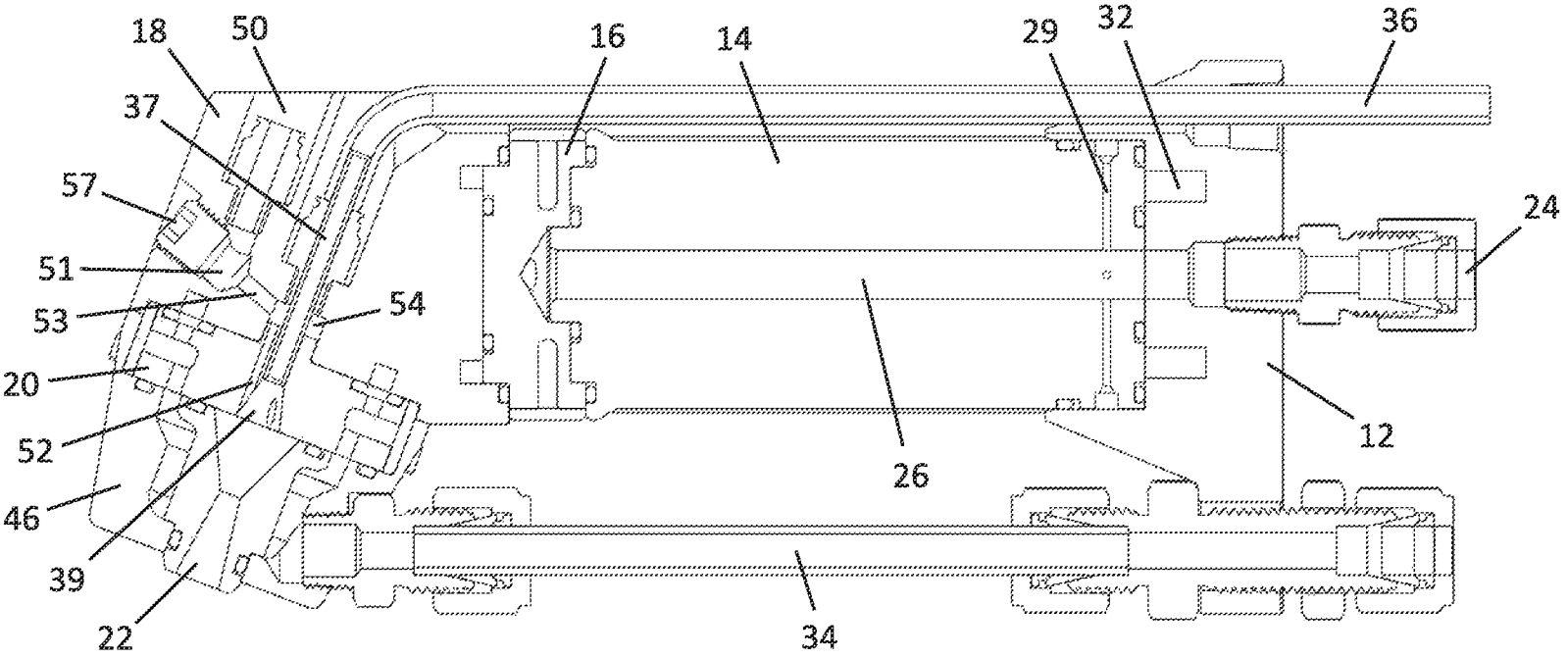
FIG. 3A is a longitudinal vertical cross-sectional view of the thermal spray gun shown in FIG. 1B taken along line 3A of FIG. 1B.
Figure 3B:
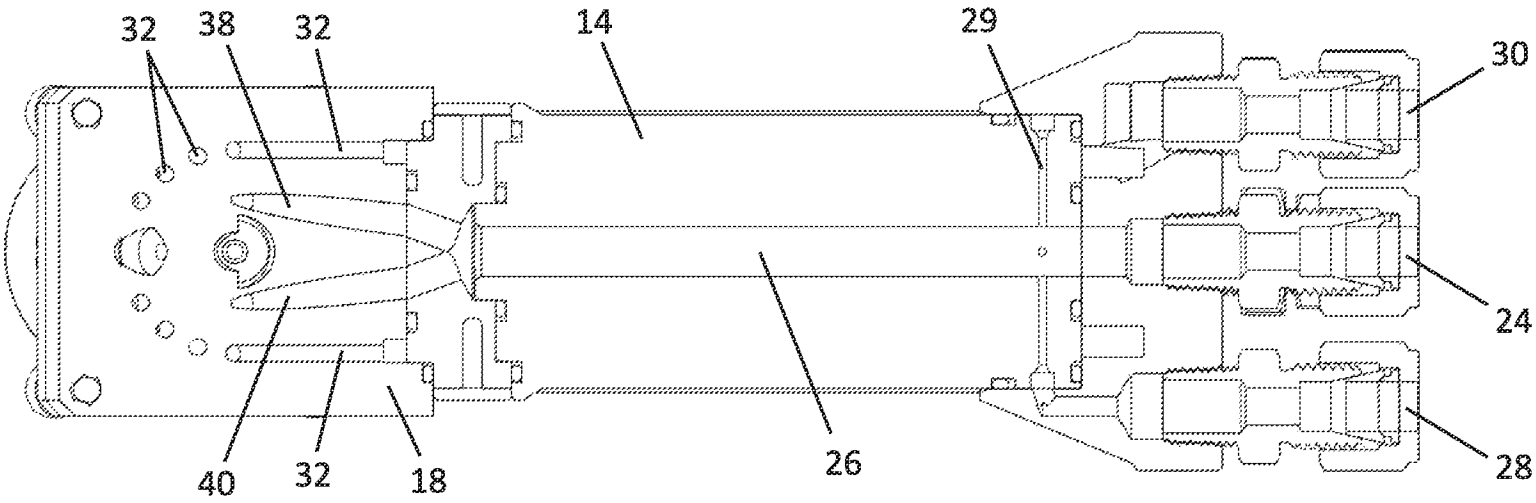
FIG. 3B is a plan view of a longitudinal horizontal cross-sectional view of the thermal spray gun shown in FIG. 1B taken along line 2B of FIG. 1B.
Figure 6A:
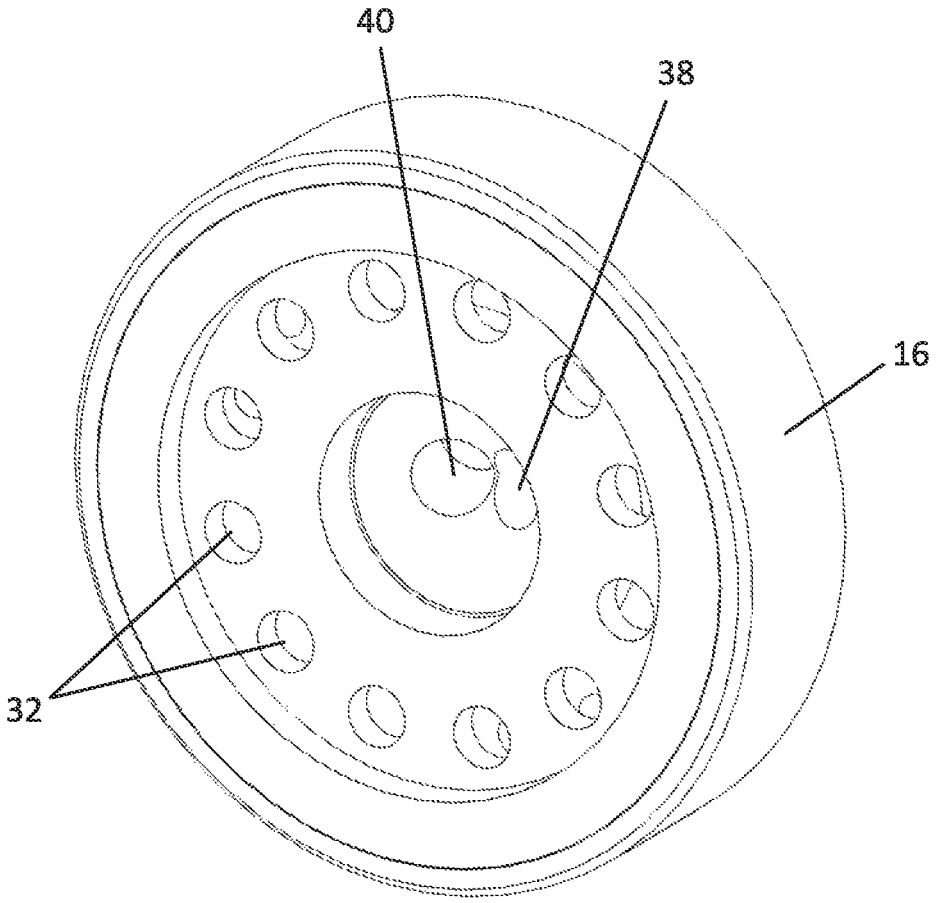
FIG. 6A is a rear isometric view of the divergence section of the thermal spray gun in isolation.
Figure 6B:
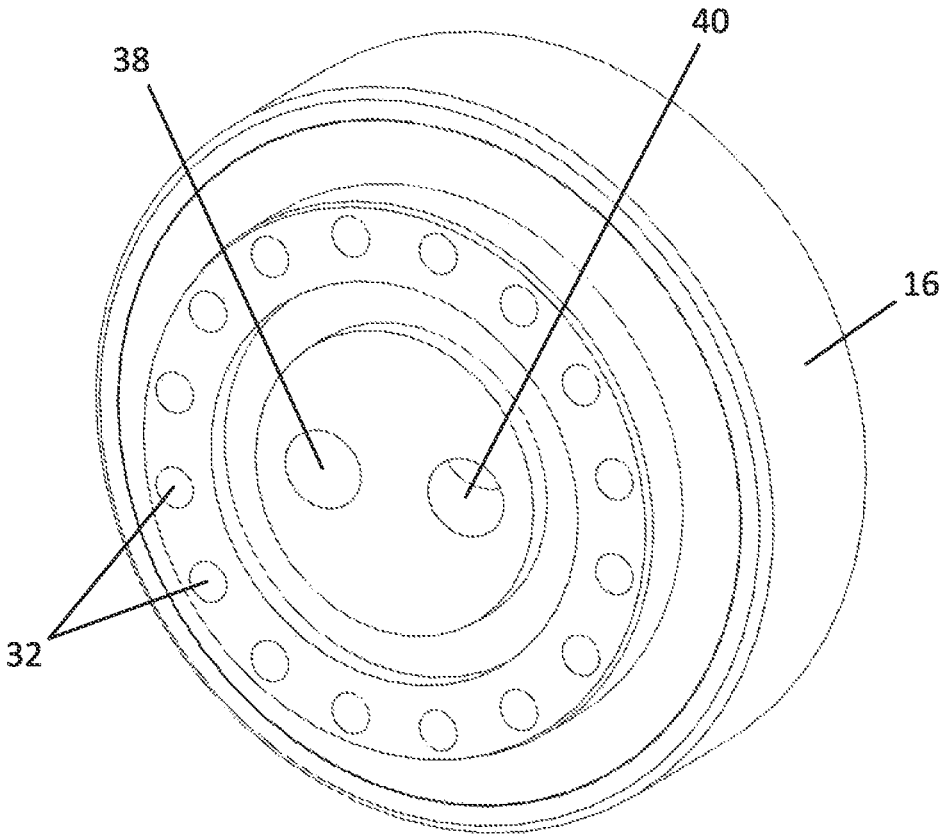
FIG. 6B is a front perspective view of the divergence section of the thermal spray gun in isolation.

With reference to FIGS. 1B and 3A, wherein the same reference numerals are used to reference the same parts as in FIG. 1A, the novel High Velocity thermal spray gun to spray wear and corrosion-resistant coatings incorporating use of a high density and/or fuel accelerating gas is shown at 10. It has a base plate 12 in which are located various input passages and chambers. It includes a combustion chamber 14, divergence section 16 (FIG. 6A, 6B), elbow housing 18, convergence assembly 20 (FIG. 7A, 7B) and nozzle 22 (FIG. 3A, FIG. 8). Nozzle 22 is retained in nozzle housing 46. Rigid tie rods 48 fix the torch body, by connecting base plate 12 at mounting holes 31 (FIG. 4A) to the elbow housing 18. Water cooling is preferred but air and/or $CO_2$ cooling may also be incorporated through the use of an accelerating fluid such as gas that goes through recuperative heating while cooling the torch. In the illustrated embodiment, the accelerating gas enters the gas stream through passages 50, 52 into the convergence area around the powder feed injection port 39 as described below. Hydrogen is again the preferred fuel, however other fuel gases such as methane, ethylene, ethane, propane, propylene or liquid fuels such as kerosene or diesel can be used.

Figure 5A:
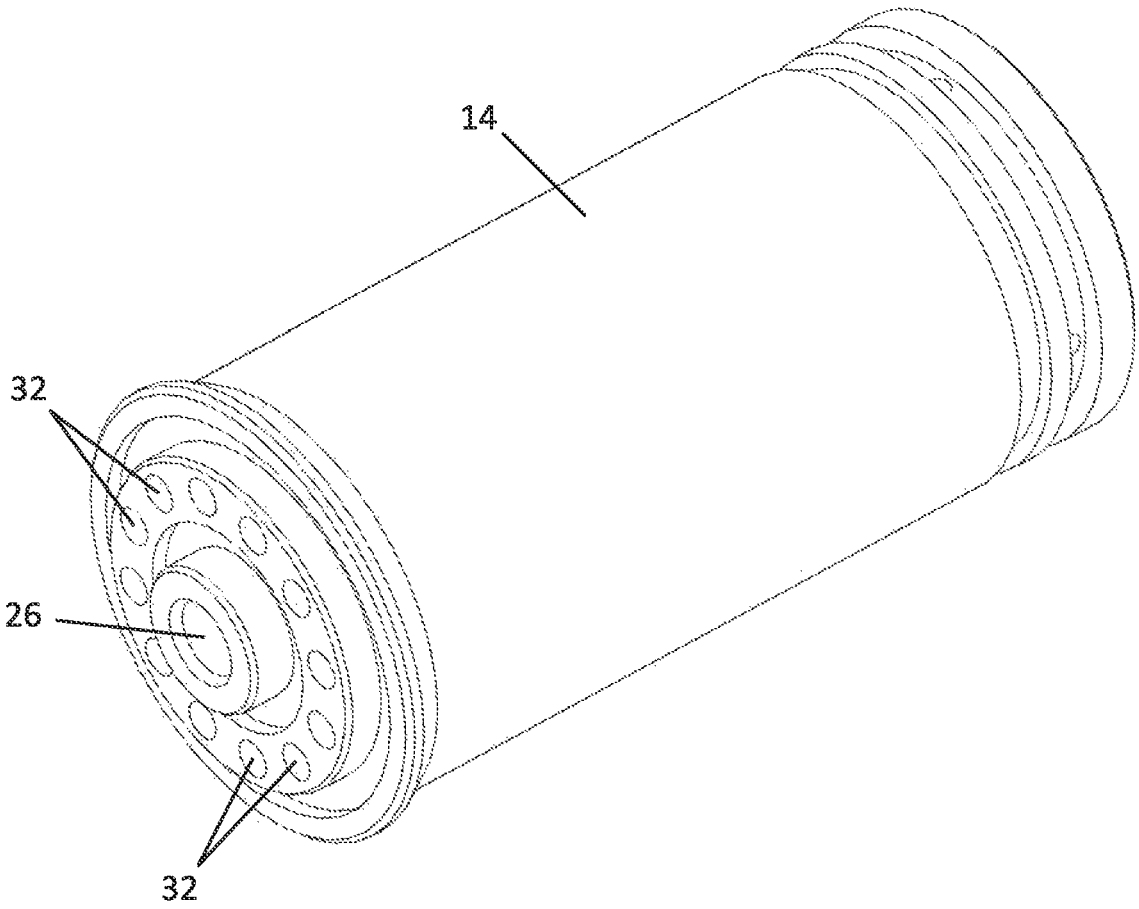
FIG. 5A is a front isometric view of the combustion chamber in isolation.
Figure 5B:
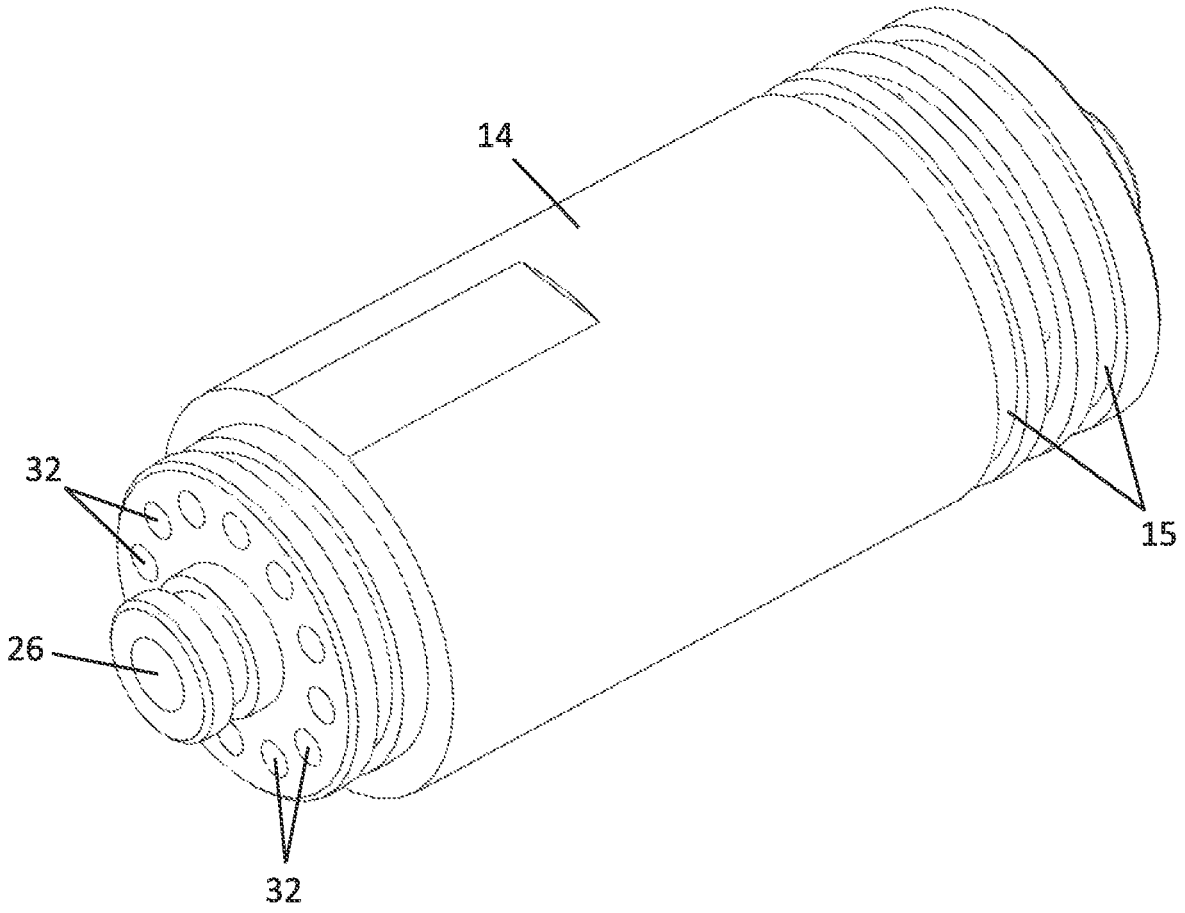
FIG. 5B is an alternate embodiment of the combustion chamber shown in FIG. 5A using radial seals.
Figure 10:
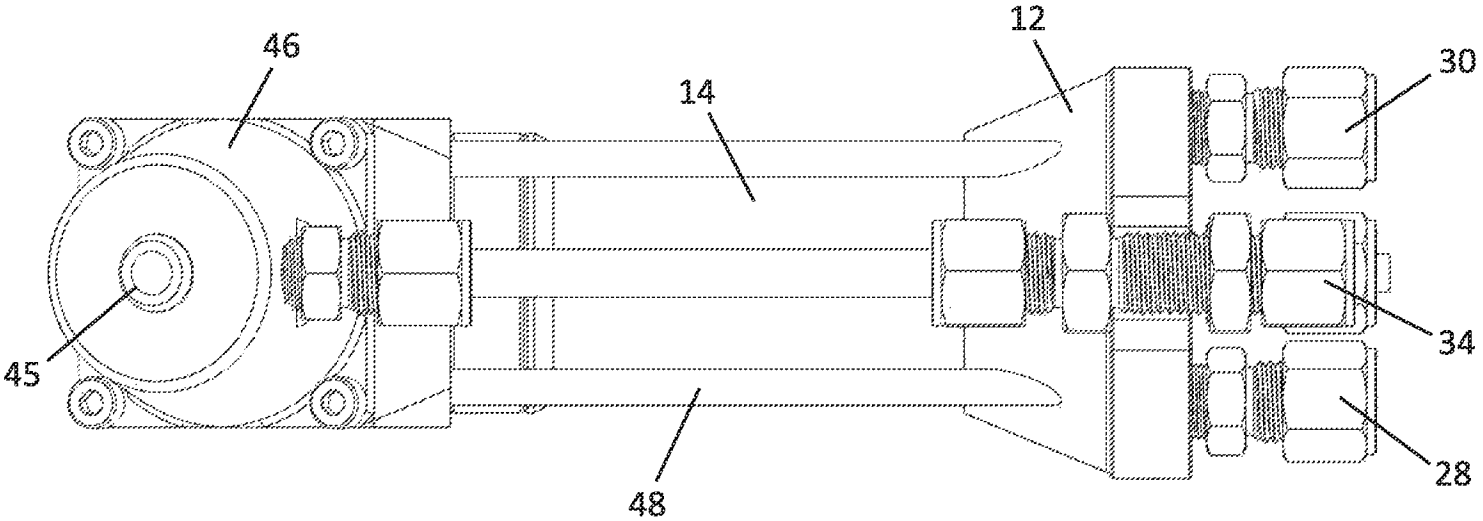
FIG. 10 is a bottom view of the thermal spray gun.

Hydrogen gas enters central channel 24 (FIG. 3A) which communicates with central passage 26 of combustion chamber 14. Coolant water enters or leaves at 34 (FIG. 10) and passes through passageways 32 (FIG. 5A) and enters or exits the torch body through line 30. While the disclosed embodiment uses water cooling, and air cooling is not incorporated, air cooling and/or $CO_2$ cooling could be used as coolants and air cooling could be added when combined with $CO_2$ as the coolant. Powder feed line 36 supplies the spray powder or other feedstock such as liquid or a suspension. Oxygen or air enters the combustion chamber through passages 28 and 29 and combusts with the fuel in passage 26 in combustion chamber 14 to form the torch flame. The accelerating gas can also be added through passages 28 and 29. When the accelerating gas is added in this location, it is added after initial combustion in an amount not great enough to extinguish the flame. While the illustrated embodiment shows the use of o-ring seals which seal axially throughout, including the combustion chamber 14 in FIG. 5A, it will be apparent that radial o-ring seals may also be used throughout, as illustrated in the alternate embodiment of the combustion chamber 14 in FIG. 5B, wherein o-rings are seated in co-axial sealing grooves 15.

Air can be used as a replacement for oxygen. In this case the torch becomes a High Velocity Air Fuel (HVAF) torch. The amount of oxygen in air is approximately 21% so the volumetric air flow will be approximately 4.8 times higher to reach the same stoichiometric conditions used for pure oxygen.

Figure 7C:
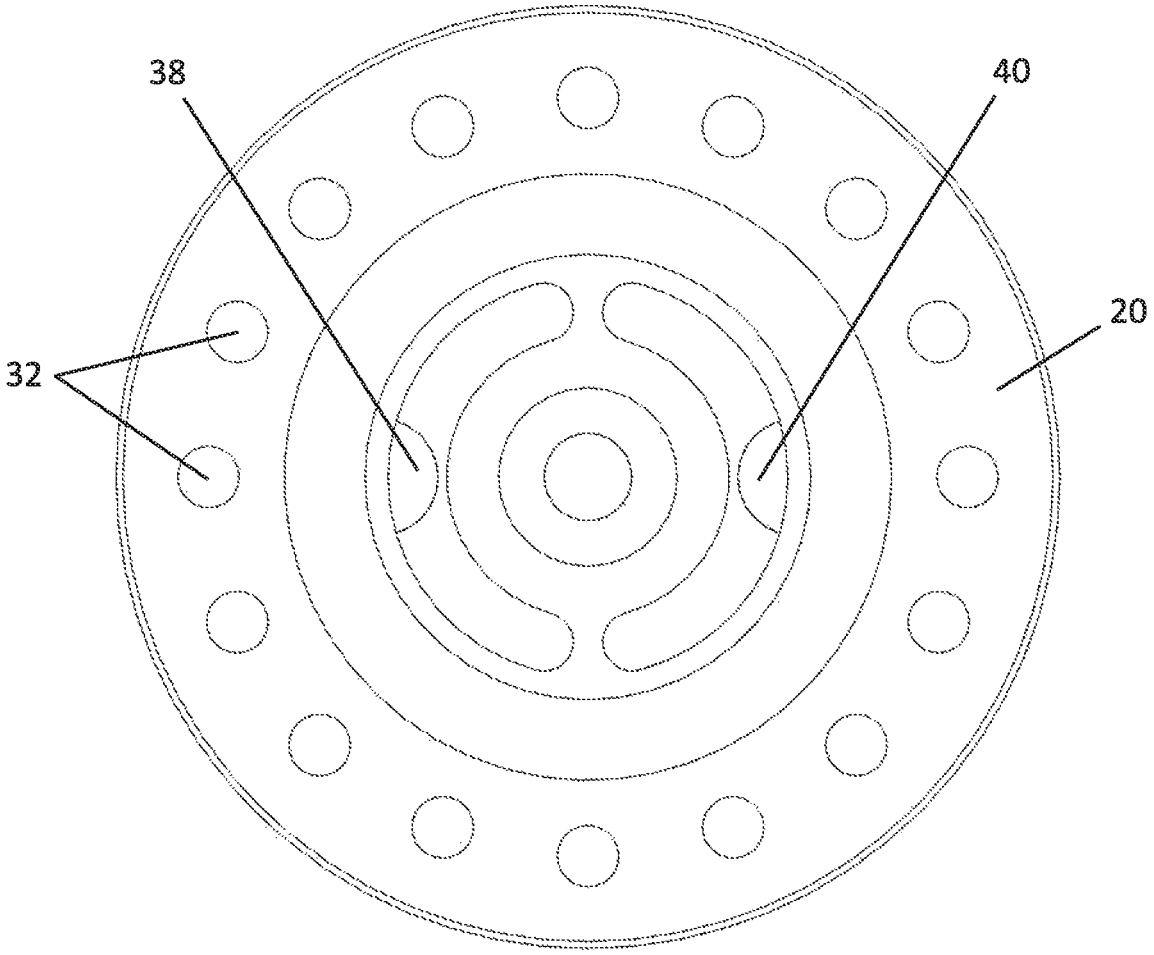
FIG. 7C is a front view of the convergence section of the thermal spray gun without accelerating gas in isolation.

The combustion stream in passage 26 is diverted in divergence section assembly 16 into two channels 38, 40 which pass through elbow 18. Powder feed tube 37 is a stainless steel or tungsten carbide tube attached to the convergence assembly 20. It is supplied by powder feed line 36 which is a synthetic polymer hose, preferably a Teflon™ hose which fits over the end of powder feed tube 37. In some cases a metal powder feed tube is preferred. The metal tube can be made from materials such as stainless steel, copper or brass. Powder feed tube 37 passes through powder channel 42 in elbow 18 (FIG. 2A) and communicates through powder feed injection port 39 in convergence assembly 20 (FIG. 7A) into the center of nozzle entrance 44. Channels 38, 40 open into a crescent shape in cross-section within the convergence assembly 20 as shown in FIGS. 7B and 7C and converge around the entry point of powder feed injection port 39 at the nozzle entrance 44.

Figure 11:
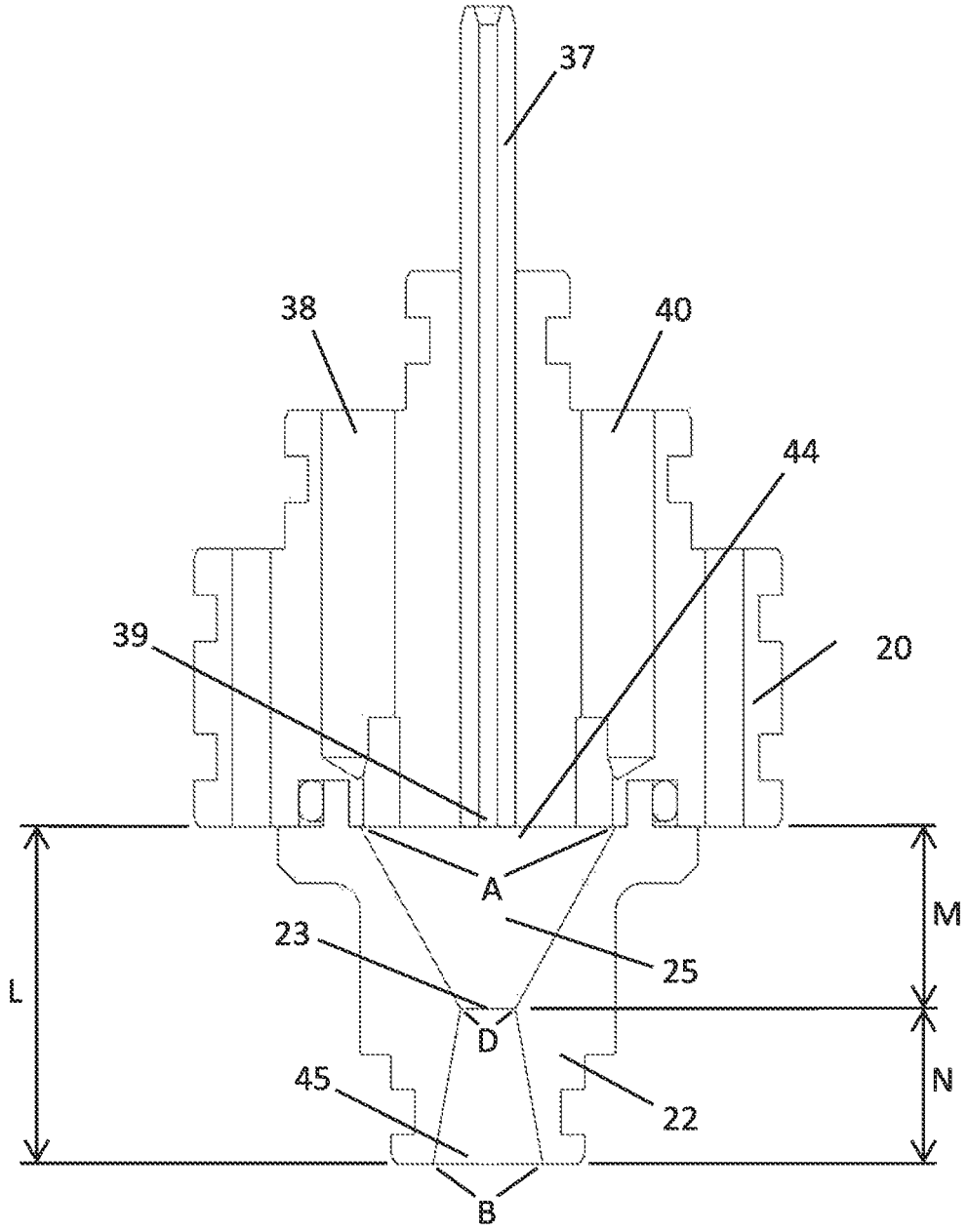
FIG. 11 is a cross-section of the convergence section and nozzle assembly.

FIG. 11 shows a convergence nozzle configuration that creates a higher pressure in the converging nozzle region than would otherwise be the case for a straight nozzle with exit internal diameter. With reference to FIG. 11, the convergence assembly 20 and nozzle 22 are shown in cross-section. Nozzle 22 has throat 23, injection zone 25, entrance 44, exit 45, entrance diameter A, exit diameter B, total length L, throat diameter D, converging length M and diverging length N. Powder feed tube communicates through powder feed injection port 39 in convergence assembly 20 into the center of nozzle entrance 44. Channels 38, 40 converge around the entry point of powder feed injection port 39 at the nozzle entrance 44.

The following equations characterize particle velocity and temperature that are important to the thermal spray process Rate of Acceleration $$\frac{dv_p}{dt} = \frac{1}{2m_p} C_D \rho_g A_P (v_g - v_p)|v_g - v_p|$$

Particle Heat Transfer $$h = k/D_p(2 + Re^{0.6} Pr^{0.33})$$

Gas pressure influences both of these in terms of increasing gas density and gas thermal conductivity.

The present invention uses short nozzles. The nozzle length is set at less than or equal to about 5 times the nozzle throat (bore) diameter D. With the nozzle length being less than or equal to about 5 times the throat diameter, and the total nozzle length L being the sum of the converging length M and diverging length N. Total nozzle length L to Throat Bore ratio for different nozzle bore diameters used herein is provided in the following Table 1.

TABLE 1

| Nozzle Dimensions | | | | | | | |
|---|---|---|---|---|---|---|---|
| Nozzle Length L mm | Throat Diameter D mm | Length:Throat ratio | Exit Diameter B mm | Exit Angle Deg (Θ) | Diverging Length N Y'/Tan (Θ) | Converging Length M mm | Entrance Diameter A mm |
| 16 | 3.5 | 4.6 | 5.0 | 4 | 10.73 | 5.27 | 12 |
| 16 | 4.0 | 4.0 | 5.5 | 4 | 10.73 | 5.27 | 12 |
| 16 | 4.5 | 3.6 | 6.0 | 4 | 10.73 | 5.27 | 12 |

TABLE 1-continued

| Nozzle Dimensions | | | | | | | |
|---|---|---|---|---|---|---|---|
| Nozzle Length L mm | Throat Diameter D mm | Length:Throat ratio | Exit Diameter B mm | Exit Angle Deg (Θ) | Diverging Length N Y'/Tan (Θ) | Converging Length M mm | Entrance Diameter A mm |
| 16 | 5.0 | 3.2 | 6.5 | 4 | 10.73 | 5.27 | 12 |
| 16 | 5.5 | 2.9 | 7.0 | 4 | 10.73 | 5.27 | 12 |

The injection zone 25 is the area within the torch where the hot gas and feedstock injection come together upstream of the nozzle throat. The nozzle throat diameter D is typically the smallest area that hot gas will pass through. Therefore, the injection zone pressure will be representative of the combustion pressure subject to minor losses.

The following table shows representative gas path channel diameters and area in embodiments of the invention.

TABLE 2

| Gas path channel diameters and area | | | | | |
|---|---|---|---|---|---|
| Hot Gas Path Flow | Inch | Diameter mm | Area $mm^2$ | Number | Total Area $mm^2$ |
| Combustion Chamber | 0.25 | 6.35 | 31.7 | 1 | 31.67 |
| Divergence | 0.157 | 4 | 12.6 | 2 | 25.13 |
| Elbow | 0.157 | 4 | 12.6 | 2 | 25.13 |
| Convergence top | 0.157 | 4 | 12.6 | 2 | 25.13 |
| Convergence Crescent | 0.157 | 4 | 12.6 | 2 | 25.14 |
| Nozzle | 0.177 | 4.5 | 15.9 | 1 | 15.90 |
| Nozzle | 0.197 | 5 | 19.6 | 1 | 19.63 |
| | 0.217 | 5.5 | 23.8 | 1 | 23.76 |

Preferably the sum of the cross-section areas of the component hot gas passages between the combustion chamber and the nozzle is greater than the cross-sectional area of the nozzle throat. This facilitates injection pressure to approximate the combustion pressure. As the torch is reduced in size, the sum of component cross sectional areas may be below the desired nozzle throat area. In this case, between the end of the combustion chamber and the end of the nozzle there are no gas path constrictions where a reduction in area would cause an upstream pressure increase until the nozzle throat. Therefore the injection pressure will approximate the combustion pressure.

For the described embodiment, the high injection pressure increases the gas density and thermal conductivity which results in an increase in heat transfer from the hot gas to the particle. Heat transfer to a particle in thermal spray applications is commonly calculated through the Ranz and Marshall correlation. As can be seen, heat transfer increases with increasing thermal conductivity k, increasing density ρ to the power 0.6. According to the product of the Re and Pr terms heat transfer will be affected by absolute viscosity to the power of −0.27. In reality, in the pressure ranges 3-15 bar, the viscosity will change very little and can be considered a constant for analysis purposes.

$$Nu=2+Re^{0.6}Pr^{0.33} \quad \text{Eq. 1}$$

Nu=Nusselt number=h $D_p$/k
h=heat transfer coefficient
$D_p$=Particle diameter
k=thermal conductivity of the gas $$h=k/D_p(2+Re^{0.6}Pr^{0.33}) \quad \text{Eq. 2}$$

Re=Reynolds Number=$\rho(V_g-V_p)D_p/\mu$
Pr=Prantl Number=$\mu\ C_p/k$
ρ=gas density
$V_g$=gas velocity
$V_p$=particle velocity
μ=absolute viscosity
Cp=specific heat
k=thermal conductivity The accelerating gas used in the embodiment of FIG. 1B may be introduced at inlet port 50 (FIG. 3A) from an accelerating gas source through high pressure tubing of stainless steel or copper (not shown). The accelerating gas travels from inlet port 50 to gas chamber 51 and then through accelerating gas connecting hole 53 into accelerating gas reservoir 54 which is sealed and surrounds powder feed tube 37. The hole to form accelerating gas connecting hole 53 is drilled from the exterior of the torch and plugged from the exterior of the torch 10 by plug 57. Accelerating gas ports 52 in convergence assembly 20 carry the accelerating gas from accelerating gas reservoir 54 to powder feed injection port 39. Accelerating gas ports 52 can vary in number and diameter. These ports 52 are preferably equally spaced around the central powder feed injection port 39 in convergence assembly 20. A preferred number of accelerating gas ports 52 is three (FIG. 7A).

The accelerating gas from ports 52 thereby is injected into the powder feed stream in powder feed injection port 39 in convergence assembly 20 which is joined in the nozzle entrance 44 by the converging combustion streams in 38 and 40. The accelerating gas joining the combustion flow increases the mass and force of the combustion stream as it accelerates through the convergent/divergent nozzle 22, allowing the flame to reach its necessary force and temperature in a shorter distance from the nozzle outlet 45 than would otherwise be possible. Hence the closer spray distance is obtained through the use of accelerating gas combined with a small physical size of the torch, increased injection pressure and increased power relative to torch size through increased power via increased fuel through the primary fuel supply and/or accelerating gas ports exiting inside the nozzle. This is partially facilitated by optimizing heat transfer resulting in improved torch cooling.

If supercritical $CO_2$ is to be used as accelerating gas, accelerating gas orifices must be such that for a given flow rate, the upstream pressure must be above the critical point of 72.9 atm (7.39 MPa, 1,071 psi) and the accelerant temperature must be above 31.1 degrees C. For example, for a flow of 0.1 liter per minute $CO_2$ with a density of 927 $kg/m^3$, a total orifice area of 0.125 $mm^2$ would necessitate a back pressure of 80.5 atm which would meet the supercritical pressure requirement. For 3 ports 52 this would equate to a hole diameter of 125 microns and for 5 ports 52 this would equate to 97 microns.

Particle acceleration in a gas flow is given by the equation:

$$\frac{dv_p}{dt} = \frac{1}{2m_p} C_D \rho_g A_P (v_g - v_p)|v_g - v_p|$$

$C_D$=Particle Drag Coefficient
$\rho_g$=Gas Density
$A_p$=Area Particle
$v_g$=velocity gas
$v_p$=velocity particle Particle acceleration can therefore be increased by increasing the gas density. The density of the gas can be determined using PV=nRT. Substituting $n=m/M_w$ $$\text{Density } \rho = m/V = M_w P/RT.$$

Therefore, density can be increased by increasing the gas molecular weight and pressure.

In one test operation the above parameters were run with a heat of combustion of 27 kW. A second operation was also run at higher power conditions of 36 kW with the following parameters:

a) $H_2$: 200 lpm
b) $O_2$: 100 lpm
c) Carrier (Ar): 15 lpm
d) Water flow: 17 lpm
e) $H_2O$ in: 25° C.
f) $H_2O$ out: 37° C.
g) Powder feeder pressure: 95 psi
h) Heat of Combustion: 36 kW Further tests at higher power levels have been performed. High power levels are accompanied by increased water flow and heat transfer to heat sensitive components.

TABLE 3

High power levels

| $H_2$ (slpm) | $O_2$ (slpm) | Combustion Power (kW) | Powder Feed (g/min) | Carrier Gas (slpm) | Nozzle Throat (mm) | Hopper Pressure (psi) | Water Flow (lpm) | Tin (° C.) | Tout (° C.) | Flame Power (kW) |
|---|---|---|---|---|---|---|---|---|---|---|
| 250 | 125 | 45.0 | 30 | | 4 | 90.1 | 30.5 | 29 | 41 | 20 |
| 300 | 150 | 54.0 | 30 | 17 | 4 | 87.1 | 25.4 | 21.7 | 40.5 | 20 |
| 350 | 175 | 63.0 | 45 | 20 | 6 | 54.7 | 25.0 | 26.6 | 40.3 | |
| 400 | 200 | 72.0 | 0 | 20 | 4 | 104 | 25 | 30 | 56 | 30 |
| 400 | 200 | 72.0 | 0 | 23 | 5 | 70 | 35 | 12 | 22 | 39 |

Carbon dioxide may be used as a coolant and accelerating gas. Carbon dioxide has a density that is 2.4 times greater than steam ($H_2O$) generated from hydrogen fueled torches.

Particle temperature and velocity measurements were made using an Accuraspray™ temperature velocity measuring device.

TABLE 4

Particle Temperature and Velocity

| H2 (slpm) | O2 (slpm) | Powder Feed (g/min) | Carrier Gas (slpm) | Nozzle Throat (mm) | Powder size (micron) | Powder Temperature (° C.) | Powder Velocity (m/s) |
|---|---|---|---|---|---|---|---|
| 300 | 150 | 30 | 17 | 4 | 5-20 | 1519 | 785 |

At temperature and pressures above 31.10° C., 72.9 atm respectively carbon dioxide is supercritical. Supercritical $CO_2$ has a density 467 kg/m$^3$ at its critical point. This compares to a density of 1.98 kg/m$^3$ at standard temperature and pressure. Using liquid carbon dioxide that is widely available, and is denser than other alternative accelerant gases at the operating temperatures is therefore preferred.

The use of carbon dioxide also has the added benefit of reducing the tendency of tungsten carbide (WC) to oxidize to $W_2C$ through the following equation.

$$2WC+O_2=W_2C+CO_2$$

By increasing the partial pressure of $CO_2$ in the system, this reaction is suppressed.

Typical initial conditions for an operating torch are as follows:

a) Hydrogen 150 slpm, Oxygen 75 slpm (27 kW)
b) Powder WC—CoCr, D50=10 μm, ρ=13.5 g/cm3
c) Initial liquid $CO_2$ at −20 C and 100-200 bar If fuel is used as an accelerating gas, the amount of fuel accelerating gas can be greater, less than or equal to the primary fuel gas flow and does not need to be the same as the primary gas type. The oxidizer will be adjusted accordingly.

A gaseous fuel such as: hydrogen, methane, ethylene, ethane, propane, propylene, or liquid fuel such as kerosene or diesel can be added through the accelerating gas inlet ports 50, 52 into the convergence to increase gas temperature and velocity. Increased temperature and pressure with transfer to the particles increase these particles temperature and velocity. With fuel accelerant being used, excess oxygen in the primary flow is used to combust the fuel in the nozzle region. The amount of accelerant fuel can be used to control the temperature and velocity of the flame and particle velocity.

While a number of exemplary aspects and embodiments have been discussed above, those of skill in the art will recognize certain modifications, permutations, additions and sub-combinations thereof. Although the operation parameters described above are typical, it is anticipated that the torch is capable of higher fuel and oxygen flow that will further allow increased temperature and velocity of gas streams and powder. It is therefore intended that the invention be interpreted to include all such modifications, permutations, additions and sub-combinations as are consistent with the broadest interpretation of the specification as a whole.

What is claimed is:

1. A high velocity oxygen fuel (HVOF) or high velocity air fuel (HVAF) thermal spray apparatus to apply coatings to external and internal surfaces of a target, said HVOF or HVAF thermal spray apparatus comprising:

a. a fuel input line;

b. an oxidizing gas input line;

c. a coolant input and an outlet;

d. a combustion chamber for primary combustion of the fuel;

e. a nozzle comprising an injection zone and a nozzle throat downstream of said injection zone;

f. a divergence section upstream of said nozzle that splits the primary combustion flow into two or more combustion streams;

g. an elbow section downstream of said divergence section which redirects the diverged combustion streams by an angle greater than 30 degrees relative to the longitudinal axis of said combustion chamber;

h. a convergence section downstream of said elbow section that recombines the diverged combustion streams into a single combustion stream within said injection zone of said nozzle; and i. a feedstock injector for the injection of feedstock material for forming said coatings into said injection zone of said nozzle.

2. The HVOF or HVAF thermal spray apparatus of claim 1 having a ratio of nozzle length to nozzle throat diameter which is less than or equal to 5.

3. The HVOF or HVAF thermal spray apparatus of claim 1 comprising a combustion gas passage for the flow of the combustion streams between the combustion chamber and the exit of said nozzle whose cross-sectional area is not significantly constricted between the combustion chamber and the exit of said nozzle except for the nozzle throat.

4. The HVOF or HVAF thermal spray apparatus of claim 3, wherein the sum of the cross-sectional areas of the combustion gas passages at each location downstream from the combustion chamber to the nozzle throat is greater than the cross-sectional area of the nozzle throat, whereby within said injection zone the injection pressure approximates the combustion pressure.

5. The HVOF or HVAF thermal spray apparatus of claim 1 wherein a gaseous fuel and oxygen is supplied to said combustion chamber.

6. The HVOF or HVAF thermal spray apparatus of claim 1 wherein a gaseous fuel and air is supplied to said combustion chamber.

7. The HVOF or HVAF thermal spray apparatus of claim 1 wherein the fuel input line supplies a gaseous fuel and oxygen and wherein an accelerating gas is supplied to said combustion chamber.

8. The HVOF or HVAF thermal spray apparatus of claim 7 wherein the gaseous fuel is hydrogen.

9. The HVOF or HVAF thermal spray apparatus of claim 1 wherein the fuel input line supplies liquid kerosene or diesel.

10. The HVOF or HVAF thermal spray apparatus of claim 7 wherein the accelerating gas is nitrogen.

11. The HVOF or HVAF thermal spray apparatus of claim 7 wherein said accelerating gas is added through independent holes in the convergence section.

12. The HVOF or HVAF thermal spray apparatus of claim 7 wherein said accelerating gas is supercritical $CO_2$.

13. The HVOF or HVAF thermal spray apparatus of claim 7 wherein said accelerating gas is a combustible fuel.

14. The HVOF or HVAF thermal spray apparatus of claim 1 wherein said convergence section comprises a plurality of crescent-shaped channels that facilitate the combustion streams to form said single combustion stream in said injection zone.

15. The HVOF or HVAF thermal spray apparatus of claim 1 wherein said feedstock is fed axially into the injection zone of the nozzle.

16. The HVOF or HVAF thermal spray apparatus of claim 7 further comprising accelerating gas ports which deliver accelerating gas axially into the injection zone of the nozzle.

17. A method of applying coatings to external and internal surfaces in restricted areas by providing the HVOF or HVAF thermal spray apparatus of claim 1, providing a fuel to said fuel input line; providing an oxidizing gas to said oxidizing gas input line; providing coolant; combusting said fuel in said combustion chamber; delivering feedstock to said feedstock injector; and forming said coatings on a target surface by directing said nozzle at said target.

18. The method of claim 17 further comprising the step of providing an accelerating gas to said injection zone of said HVOF or HVAF thermal spray apparatus.

19. The method of claim 18 wherein carbon dioxide is used as a coolant or accelerating gas to thereby reduce the oxidation of tungsten carbide (WC) to $W_2C$.

20. The method of claim 17 which axially injects powder in a region of high pressure approximating the combustion pressure.

* * * * *